US005617618A

United States Patent [19]

Fleissner

[11] Patent Number: 5,617,618

[45] Date of Patent: Apr. 8, 1997

[54] METHOD AND DEVICE FOR FINISHING THICK CARDED FLEECES

[75] Inventor: Gerold Fleissner, Zug, Switzerland

[73] Assignee: Fleissner GmbH & Co., Maschinenfabrik, Egelsbach, Germany

[21] Appl. No.: 571,770

[22] Filed: Dec. 13, 1995

[30] Foreign Application Priority Data

Dec. 13, 1994 [DE] Germany ..... 44 44 206.8

[51] Int. Cl.[6] ..... D04H 1/54

[52] U.S. Cl. ..... 28/103; 28/143

[58] Field of Search ..... 28/140, 143, 158, 28/165, 166, 169, 116; 19/296, 145, 302; 264/109, 119, 121, 122; 156/166, 167, 176, 177, 178, 180, 181; 68/20, 19, 15

[56] References Cited

U.S. PATENT DOCUMENTS 4,481,694 11/1984 Dilo ..... 19/296
4,767,586 8/1988 Radwanski et al. ..... 264/121
5,023,027 6/1991 Nopper ..... 264/119
5,144,729 9/1992 Austin et al. ..... 28/105
5,240,764 8/1993 Haid et al. ..... 28/105
5,375,306 12/1994 Roussin-Moynier ..... 19/296
5,413,849 5/1995 Austin et al. ..... 28/105

*Primary Examiner*—C. D. Crowder
*Assistant Examiner*—Larry D. Worrell, Jr.
*Attorney, Agent, or Firm*—Antonelli, Terry, Stout & Kraus, LLP

[57] ABSTRACT

A method wherein a thin card web which contains meltable synthetic fibers as well as natural fibers is processed into a thicker web of fleece. The synthetic fibers are initially melted to prestrengthen the web. Then the web is saturated with the appropriate fluid finishing agent for making the web flame-resistant and the like and this web can then be readily dried on a screen drum dryer. It is at this point that the web layers are accumulated into a proper fleece in a cross layer unit which transfer the end product to a heat treatment assembly for heating to effect vulcanization, curing or setting of the synthetic fibers.

2 Claims, 1 Drawing Sheet

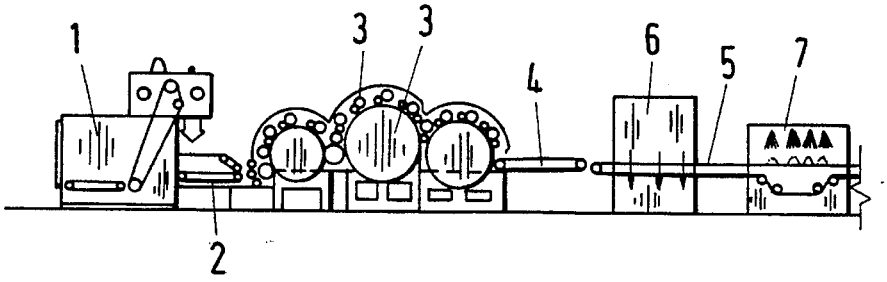
1
2
3
3
4
5
6
7
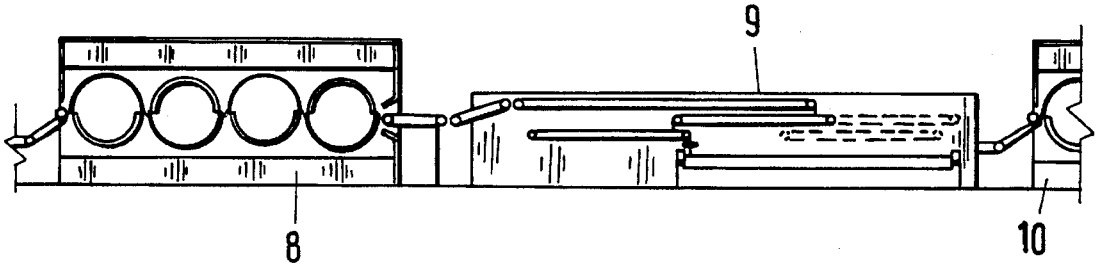
8
9
10

METHOD AND DEVICE FOR FINISHING THICK CARDED FLEECES

FIELD OF THE INVENTION

This invention relates to a method for manufacturing a carded fleece, with the fleece being produced from various fibers, such as natural fibers including wool, linen, and flax, and from synthetic fibers such as bi-component and meltable fibers, with the fleece being treated with fluid finishing agent such as insecticides, rotproofing agents, flameproofing agents, and the like, and then dried.

BACKGROUND OF THE INVENTION

Thinner carded fleeces in particular made of wool, flax, linen, or other natural fibers do not have sufficient strength immediately after they are produced on the carding machine. It is, therefore, known to mix binders with the fibers. In general, the binders are applied after the fleece is produced, for example, by spraying or impregnating the fleece with foam. In the wet state, however, the thin carded fleece is difficult to manipulate, and tears easily. It is, therefore, also known to mix the natural fibers with artificial or synthetic fibers before the carded fleece is produced, for example by adding bi-component fibers or pure meltable fibers, and then to heat the thin fleece to the temperature of the plasticizable components of the added artificial fibers in order to at least prestrengthen the fleece. Then the carded fleece is laminated several times in a cross layer arrangement and finally solidified by heating it in an oven.

Fleeces of this kind must be additionally finished before they are used as intended. This includes treatment against rotting and against flammability. It is, therefore, known to spray the completed fleeces with a fluid finishing agent, and then to dry this fluid by the action of heat. It has been found that the finishing agent thus applied to the finished or completed fleece cannot be distributed sufficiently uniformly over the thick cross section of the fleece. It has, therefore, been proposed to mix the finishing agent, which must necessarily be applied in fluid form, with the fibers before the carded fleece is produced, to dry the fibers, and then to produce the fleece on the carding machine using the method described above. This approach has not been successful, however, since the finishing agent adhering to the fibers comes loose from the fibers again during carding and is, therefore, lost.

SUMMARY OF THE INVENTION

The goal of the invention is to develop a process and a device on which a carded fleece can be produced that is not only tear-resistant, but is also protected uniformly throughout its thickness against rot and flammability.

On the basis of the process of the type heretofore described, the solution according to the invention, lies in the fact that initially a thin carded web or fleece is produced and then prestrengthened by heating and at least melting or melting-on of a synthetic fiber component, whereupon the (fluid) finishing agent(s) is/are sprayed onto the web or otherwise applied, after which the web is heat-treated to dry it and then folded over many times in a cross layer arrangement to form a thicker fleece end product, and finally this product is solidified (in this package) by further heat treatment.

The success of this method lies in the fact that the fluid finishing agent is only added after prestrengthening of the thin carded fleece, with the fleece preferably being dried first for economic reasons. Fluid finishing agents readily penetrate crosswise through the carded fleece which is still thin and which, thanks to prestrengthening, can be dried rapidly owing to its limited thickness. The desired complete flame resistance, for example, of the end product, which is thicker after it leaves the cross layer processing stage, is achieved with this method.

A device for working this method comprises a carding machine, a heat treatment assembly and a cross layering unit arranged in a series in a continuous processing line, wherein downstream of the carding machine, the heat treatment assembly including a calender or belt drier for surface melting of the synthetic fibers, is arranged followed by an application device for distributing a fluid finishing agent uniformly and transversely over the thin carded fleece by a drying assembly including a screen drum dryer for drying the fluid finishing agent on the fleece and then by the cross layering unit for producing a thicker fleece product and subsequently by a heat treatment assembly for heating the thicker fleece product.

BRIEF DESCRIPTION OF THE DRAWINGS

The device of this invention is shown schematically as an example in the accompanying drawings in which the sole FIGURE shows the arrangement of the elements of the device in a schematic side view.

DETAILED DESCRIPTION OF THE INVENTION

The machinery consists of a hopper feeder 1 with a vibrating slide 2 located beneath it, said slide transferring the loose accumulation of fibers spread across its width to the fleece- or web-laying device 3 to form a carded thin fleece. An endless belt 4 then transfers the fleece or web to another endless belt 5 that advantageously extends through both a heating device 6 and a fluid-spraying device 7. The heating device is designed in this case as a belt dryer in which heated processing air used to melt the synthetic fibers after regeneration in a heating device in a circuit is sucked through the endless belt. The arrows in the drawings are intended to show the flow of the heated air. A calender dryer can be used here as well. At this point the fleece is prestrengthened at least on the surface so that the addition of the fluid finishing agent in the associated spraying device 7 has no disadvantageous affects on the slightly solidified web. The fluid finishing agent that is added must now be dried. This takes place in screen drum device 8 in which the fleece is likewise traversed by air and guided meanderwise around the drums. Finally, the fleece passes to a cross layering unit 9 in which the web is folded over on itself to form a thicker fleece. The thicker fleece product then moves on into an assembly 10, including screen drums for heating and for vulcanization, curing or setting of the fibers and the finishing agent followed by other, further processing.

What is claimed is:

1. A method for manufacturing a carded thick fleece product, from natural fibers selected from the group consisting of wool, linen, and flax, and from synthetic fibers selected from the group consisting of bi-component and meltable fibers, which comprises initially producing a thin carded fleece from the natural and the synthetic fibers, prestrengthening the thin carded fleece by heating to effect at least melting or melting-on of the synthetic fibers, applying a fluid finishing agent to the prestrengthened fleece, heat treating the fleece with the fluid finishing agent to dry the finishing agent, then folding over the fleece containing the finishing agent on itself many times in a cross layering unit to form a thick fleece end product, and further heat treating the product to provide a finally solidified fleece product.

2. A device for manufacturing a carded fleece from natural and synthetic fibers which comprises a carding machine, a first heat treatment assembly, a fluid application unit, a drying assembly, a cross layering unit and a second heat treatment assembly arranged in a series in a continuous processing line, the carding machine producing a thin carded fleece from the natural and synthetic fibers, the first heat treatment assembly, arranged downstream of the carding machine, including a conveyor dryer for conveying the thin carded fleece and for surface melting of the synthetic fibers, the fluid application device distributing a fluid finishing agent uniformly and transversely over the thin carded fleece, the drying assembly including a screen drum dryer for drying the fluid finishing agent on the fleece, the cross layering unit folding over the thin fleece containing the dried finishing agent to produce a thick fleece product and the second heat treatment assembly heating the thick fleece product to finally solidify the product.

* * * * *